US006945018B2

(12) United States Patent
Suolahti

(10) Patent No.: US 6,945,018 B2
(45) Date of Patent: Sep. 20, 2005

(54) WRAPPING MACHINE AND TOP FOIL WRAPPING MACHINE

(75) Inventor: Yrjo Suolahti, Mynämäki (FI)

(73) Assignee: Oy.M. Haloila AB, Masku (FI)

( * ) Notice: Subject to any disclaimer, the term of this patent is extended or adjusted under 35 U.S.C. 154(b) by 0 days.

(21) Appl. No.: 10/786,163

(22) Filed: Feb. 26, 2004

(65) Prior Publication Data

US 2004/0226271 A1 Nov. 18, 2004

(30) Foreign Application Priority Data

Feb. 27, 2003 (FI) ..... 20030304

(51) Int. Cl.[7] ..... B65B 11/00
(52) U.S. Cl. ..... 53/588; 053/556; 053/210
(58) Field of Search ..... 53/588, 556, 210, 53/176, 211

(56) References Cited

U.S. PATENT DOCUMENTS

| | | | | | |
|---|---|---|---|---|---|
| 4,109,445 | A | * | 8/1978 | Shulman | 53/588 |
| 4,369,614 | A | * | 1/1983 | Tetzner | 53/556 |
| 4,565,051 | A | * | 1/1986 | Back | 53/441 |
| 4,587,796 | A | | 5/1986 | Haloila | |
| 4,756,143 | A | * | 7/1988 | Lancaster | 53/556 |
| 5,131,209 | A | * | 7/1992 | Schreiber et al. | 53/399 |
| 5,517,807 | A | | 5/1996 | Morantz | |
| 6,594,970 | B1 | * | 7/2003 | Hyne et al. | 53/399 |
| 6,598,379 | B2 | * | 7/2003 | Zitella et al. | 53/556 |
| 6,742,322 | B2 | * | 6/2004 | Qicang | 53/588 |
| 6,826,893 | B2 | * | 12/2004 | Cere' | 53/556 |
| 6,848,239 | B2 | * | 2/2005 | Shibazaki et al. | 53/399 |
| 6,880,311 | B2 | * | 4/2005 | Winkler | 53/399 |

FOREIGN PATENT DOCUMENTS

EP 1 209 081 A1 5/2002

* cited by examiner

*Primary Examiner*—Sameh H. Tawfik
(74) *Attorney, Agent, or Firm*—Lowe Hauptman & Berner, LLP

(57) ABSTRACT

The invention relates to a wrapping machine and/or top foil wrapping machine, comprising a machine frame supported on a fixed base and comprising upright vertical columns; a lifting frame arranged to be vertically movable upwards and downwards and guided by the vertical columns; a lifting motor for moving the lifting frame, power transmission means for the transmission of power from the lifting motor to produce vertical motion of the lifting frame, said power transmission means comprising elongate flexible drive elements and wheels for the transmission of the power of the lifting motor to the drive elements. The wrapping machine further comprises a foil dispenser, on which a foil web roll can be rotatably supported. The top foil wrapping machine comprises a top foil depositor. The lifting motor is secured to the lifting frame so as to be movable with it. The wheels comprise a drive belt pulley fitted for reeling a flat belt. The drive belt pulley is rotatably mounted on bearings on the lifting frame and rotated by the lifting motor. Each one of the elongate drive elements consists of a drive belt whose first end is secured to the upper end of the vertical columns while the second end is secured to the drive belt pulley.

16 Claims, 4 Drawing Sheets

WRAPPING MACHINE AND TOP FOIL WRAPPING MACHINE

FIELD OF THE INVENTION

Figure 1:
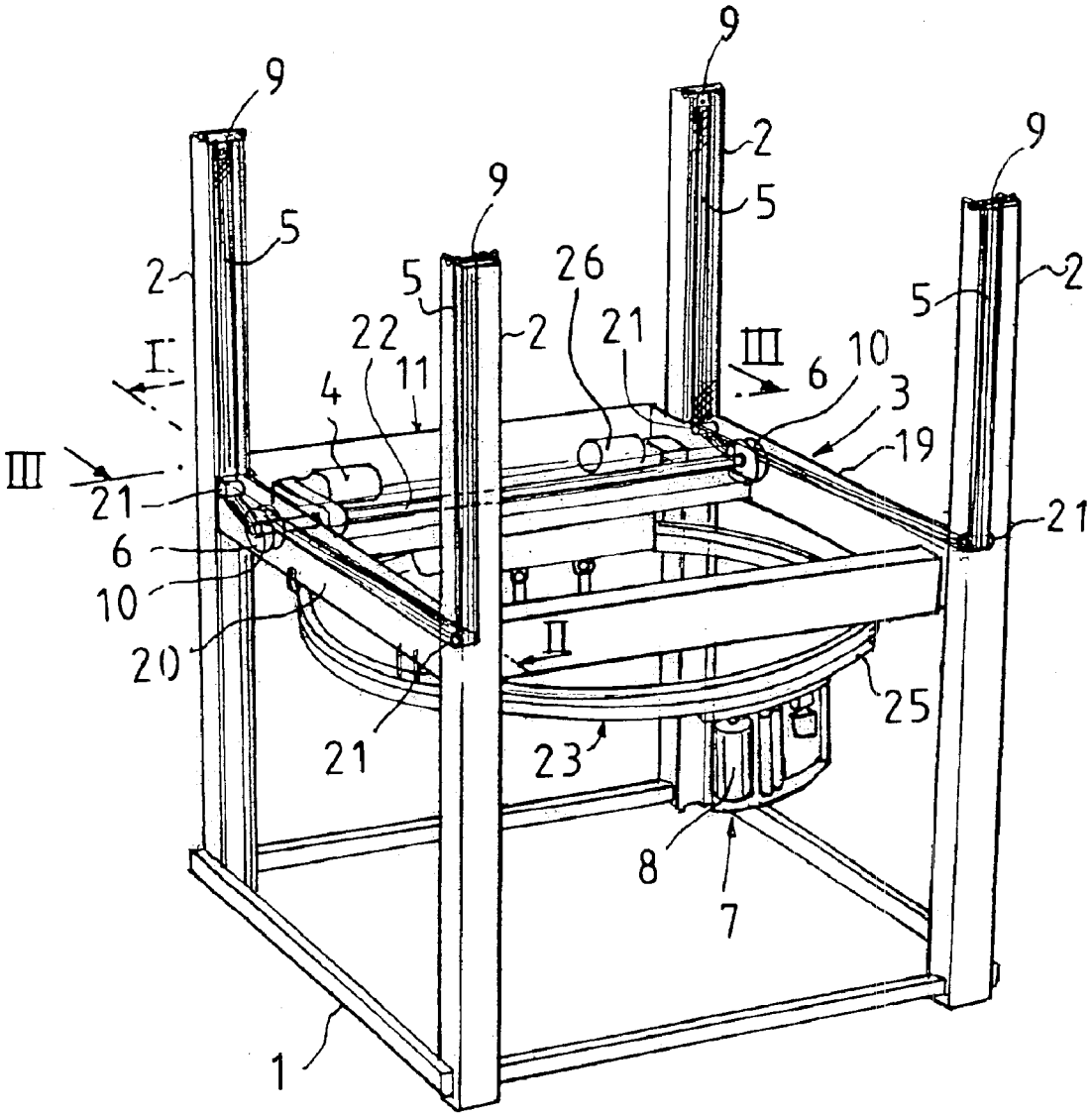

The present invention relates to a wrapping machine. Furthermore, the invention relates to a top foil wrapping machine.

BACKGROUND OF THE INVENTION

In prior art, a wrapping machine used to wrap a plastic foil web around an object to be wrapped is known. Similarly, a top foil wrapping machine used to set a desired length of top foil onto an object to be wrapped is known.

The object to be wrapped is usually a load placed on a pallet, which typically is an assembly of the form of a rectangular parallelepiped. A feature common to the wrapping machine and the top foil wrapping machine is that they comprise a machine frame supported on a fixed floor base. The frame usually comprises four upright vertical columns. The wrapping machine or top foil wrapping machine further comprises a lifting frame arranged to be vertically movable upwards and downwards, being guided by the vertical columns. Further, the wrapping machine or top foil wrapping machine comprises a lifting motor for moving the lifting frame, and power transmission means for the transmission of power from the lifting motor to produce vertical motion of the lifting frame. The power transmission means comprise elongate flexible drive elements and wheels for the transmission of the power of the lifting motor to the drive elements.

The wrapping machine further comprises a foil dispenser, on which a foil web roll can be rotatably supported. Supported by the lifting frame is a wrapping frame, which usually forms a circular endless path for the foil dispenser. The foil dispenser circulates along this path around the object to be packaged, allowing the plastic foil web to be unrolled from the foil web roll to form a wrapping around the object to be packaged.

The top foil wrapping machine has a top foil depositor supported on or connected to the lifting frame and arranged to deposit a top foil from the top foil web roll onto the object to be wrapped.

This type of prior-art wrapping machine or top foil wrapping machine has a so-called top frame fixed to the upper ends of the vertical columns and consisting of beams connecting the upper ends of the vertical columns. The lifting motor is connected to this top frame. The aforesaid elongate drive elements of the power transmission means transmitting the power of the lifting motor to produce a vertical motion of the lifting frame are power transmission chains and the wheels are chain sprockets. Mounted at the upper and lower ends of each vertical column are diverting sprockets, over which the vertically moving endless chain runs. The lifting frame is fixed to these vertical chains. A diverting sprocket on one of the vertical columns is driven by the lifting motor. From this single lifting motor, power is correspondingly transmitted to the other side of the machine by chains via diverting and tensioning sprockets rotatably mounted on the top frame. The diverting sprockets at the upper ends of opposite vertical columns are connected to each other by shafts. With this arrangement, the lifting frame fixed to the chains at four points is raised and lowered evenly by means of a single lifting motor.

A problem with the prior-art wrapping machine or top foil wrapping machine is that the task of assembling it is difficult to carry out. Numerous parts have to be mounted on the top frame at a relatively large height from the floor level, which, besides being difficult, is also problematic in respect of work safety. The prior-art wrapping machine or top foil wrapping machine contains various parts requiring regular maintenance that are located at a large height. For example, the bearings of the shafts and sprockets have to be repeatedly lubricated, which is why it is necessary to provide special lubricant pipes for passing a lubricant to the objects to be lubricated. Further, the mechanism needed for moving the lifting frame in the prior-art wrapping machine or top foil wrapping machine comprises a very large number of components, resulting in a complicated and expensive construction. Moreover, as the lifting motor, which usually is an electric motor, is mounted on the top frame, very long cables are needed for electricity supply and control.

OBJECT OF THE INVENTION

The object of the present invention is to overcome the above-mentioned drawbacks.

A specific object of the invention is to disclose a wrapping machine and/or top foil wrapping machine that is simpler in construction than earlier machines and contains as few components as possible.

A further object of the invention is to disclose a wrapping machine and/or top foil wrapping machine that contains no installation or maintenance objects located high up above the floor level.

A further object of the invention is to disclose a wrapping machine and/or top foil wrapping machine whose assembly and maintenance can be carried out while the person performing the work is working at the floor level without having to climb high up to perform the work.

A further object of the invention is to disclose a wrapping machine and/or top foil wrapping machine in which the required cabling for electricity and control can be made short.

BRIEF DESCRIPTION OF THE INVENTION

The wrapping machine of the invention is characterized by what is disclosed in claim 1. Further, the top foil wrapping machine of the invention is characterized by what is disclosed in claim 10.

According to the invention, the lifting motor of the lifting frame of the wrapping machine and/or top foil wrapping machine is secured to the lifting frame so as to be movable with it. The wheels of the power transmission means comprise a drive belt pulley fitted for reeling a belt, said drive belt pulley being rotatably mounted by means of a bearing on the lifting frame and rotated by the lifting motor. Each one of the elongate drive elements consists of a drive belt whose first end is secured to the upper end of the vertical columns while the second end is secured to the drive belt pulley. Thus, when the drive belt pulley is rotated by the lifting motor, the drive belt is reeled around it, thereby moving the lifting frame.

As the lifting motor is placed on the lifting frame and the motion is implemented using belts and pulleys, an assembly-friendly wrapping machine construction is achieved because the apparatus can be assembled without working at a level high up above the floor. The lifting frame together with the motor forms a unitary subassembly, which can be assembled in an ergonomic manner e.g. on the top of a work table. Likewise, all the essential maintenance objects are located in the lifting frame, which can be adjusted to a suitable height for maintenance. The motor control and electricity cables can be made short. The construction of the wrapping machine and/or top foil wrapping machine is simple and it contains only few components.

In an embodiment of the wrapping machine and/or top foil wrapping machine, the wrapping machine comprises four vertical columns, arranged in a rectangular configuration at the corners of a rectangle at a distance from each other. The lifting frame has the form of a substantially rectangular frame and is arranged in a horizontal orientation within the area defined by the vertical columns.

In an embodiment of the wrapping machine and/or top foil wrapping machine, the lifting frame comprises an equipment box, whose interior space is defined below by a bottom, laterally by side walls and above by a cover. The lifting motor is mounted in this interior space.

In an embodiment of the wrapping machine and/or top foil wrapping machine, the lifting frame comprises two parallel elongate lateral frame parts, each extending horizontally between two vertical columns. The drive belt pulley is mounted in a position aligned with a lateral frame part and a diverting pulley is provided at each end of the two lateral frame parts, the drive belt coming from the drive belt pulley being passed over said diverting pulleys to the upper end of the vertical column.

In an embodiment of the wrapping machine and/or top foil wrapping machine, the power transmission means comprise a drive shaft to which the lifting motor is coupled to rotate it. A drive belt pulley is mounted at each end of the drive shaft.

In an embodiment of the wrapping machine, the wrapping machine comprises a circular ring arrangement, which forms the path of motion of the foil dispenser and which is mounted on the lifting frame so as to be vertically movable with it.

In an embodiment of the wrapping machine, the circular ring arrangement comprises a ring-like rotary frame suspended horizontally so that it is supported by the lifting frame and mounted on bearings on the lifting frame so as to be rotatable about its center, the foil dispenser being secured to said rotary frame to circulate with it, and a rotating motor for rotating the rotary frame.

In an embodiment of the wrapping machine, the rotating motor is placed in the interior space of the equipment box. Placing the rotating motor in the same box with the lifting motor further facilitates assembly and maintenance.

In an embodiment of the wrapping machine, the wrapping machine comprises a control device for controlling the operation of the wrapping machine, such as the operation of the lifting motor and/or the rotating motor. The control device is placed in the interior space of the equipment box, so the control device is as close as possible to the motors to be controlled and the cables are short.

The top foil wrapping machine differs from the wrapping machine mainly in that, instead of a circular ring arrangement and a foil dispenser, it has a top foil depositor arranged to deposit a top foil from a top foil web roll onto the object to be wrapped.

In an embodiment of the top foil wrapping machine, the top foil depositor comprises a depositor frame secured to the lifting frame. In addition, it has supporting elements for rotatably supporting a top foil web roll on the depositor frame. Further, the top foil depositor comprises a holding device for holding the end of the top foil web. A horizontally movable gripping element has been arranged to grip the end of the top foil web, take it from the hold of the holding device and draw it over the object to be packaged. A cutting device cuts the top foil web drawn over the object.

LIST OF FIGURES

Figure 2:
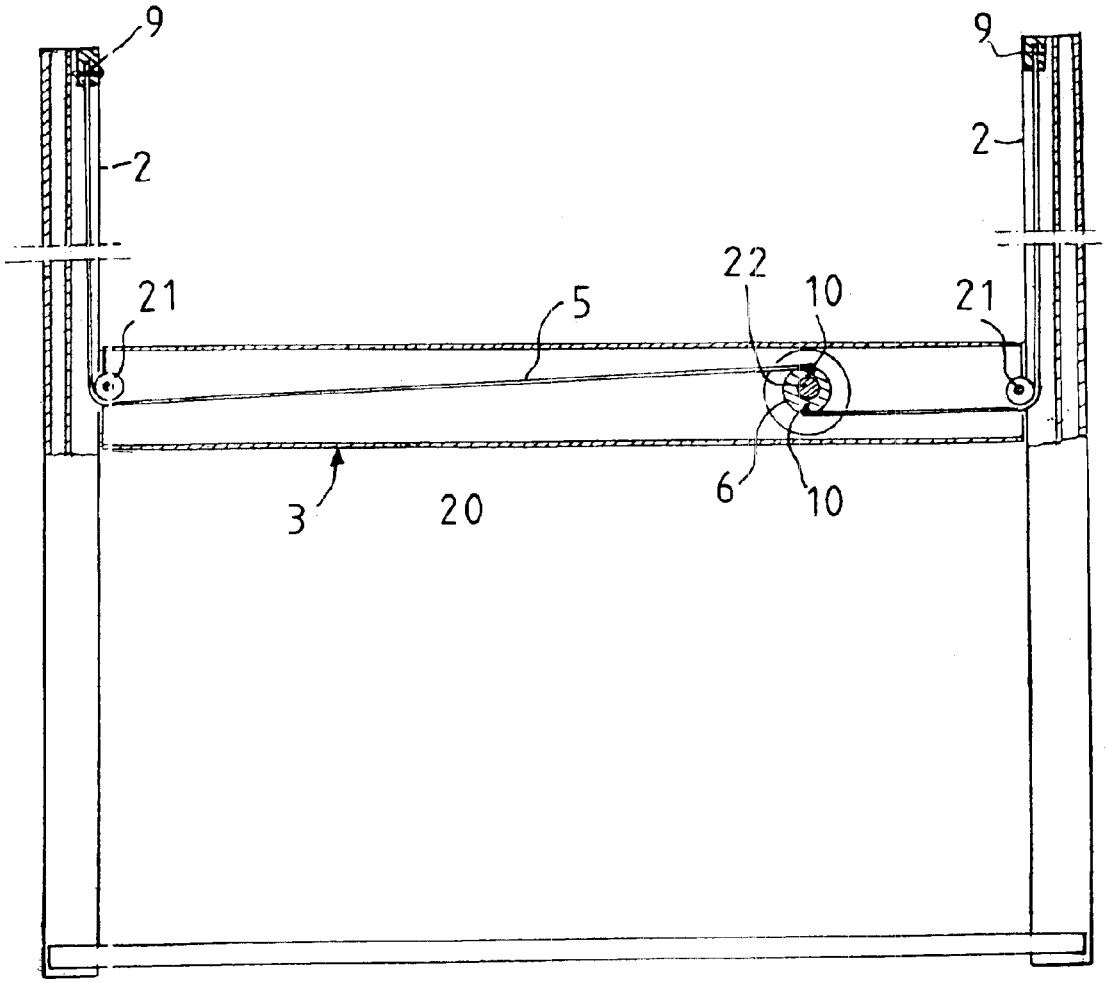
Figure 3:
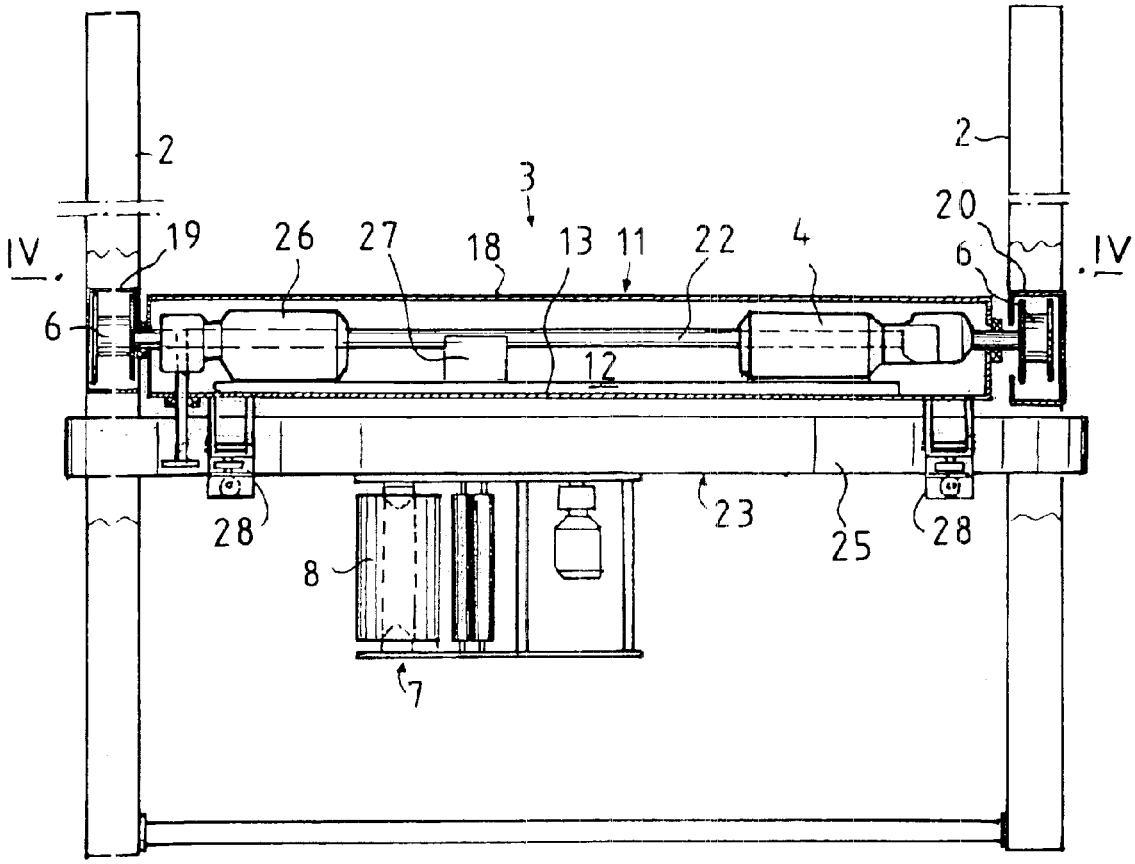
Figure 4:
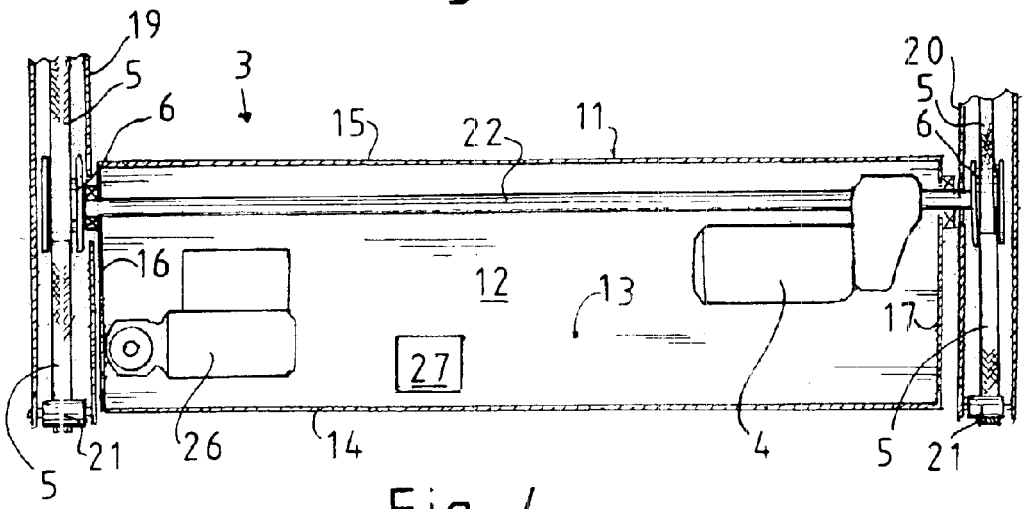
Figure 5:
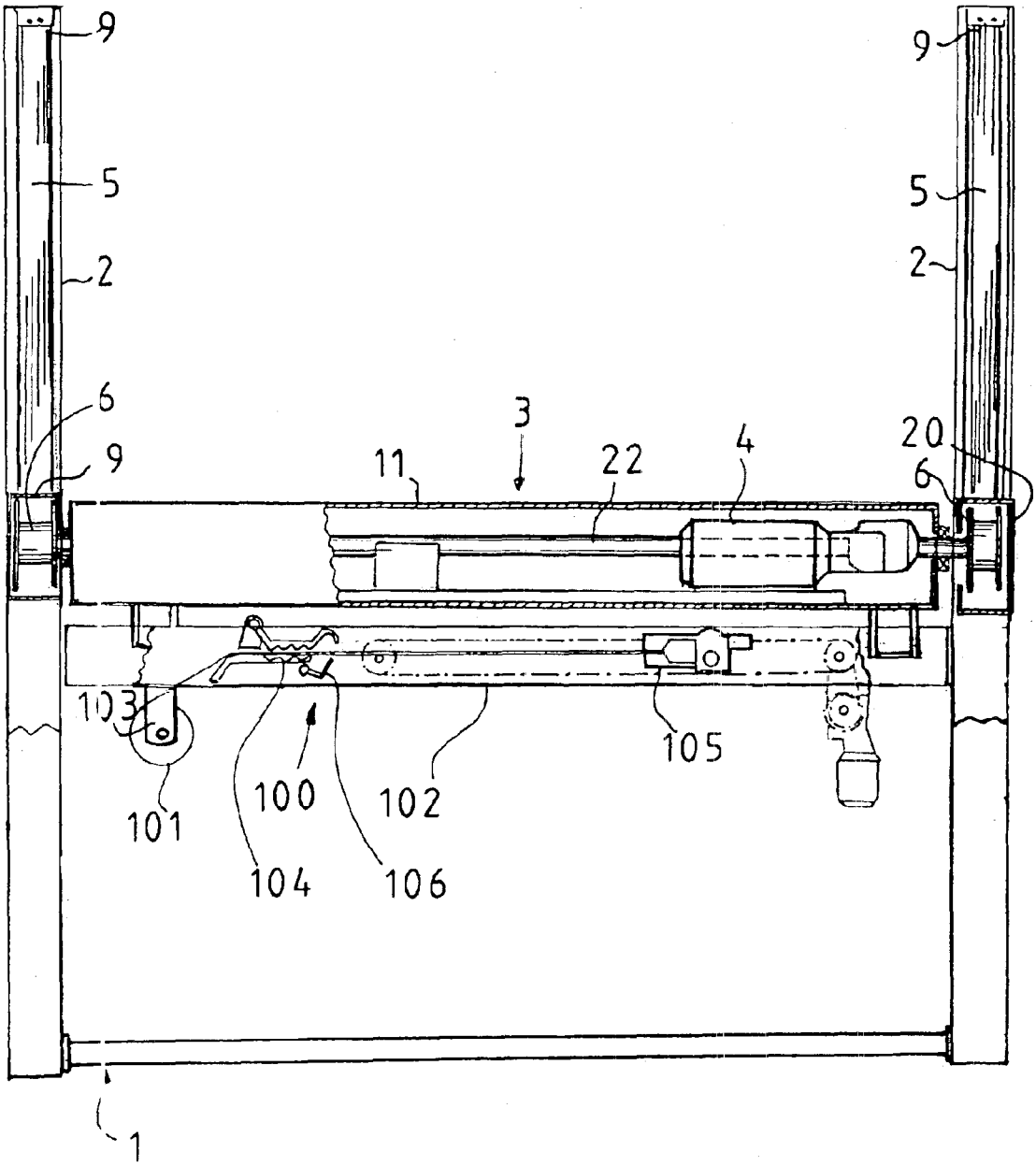

In the following, the invention will be described in detail by the aid of an embodiment example with reference to the attached drawing, wherein FIG. 1 presents an axonometric oblique top view of an embodiment of the wrapping machine of the invention, with the lifting frame and the vertical columns depicted as being transparent to visualize the drive arrangement of the lifting frame, FIG. 2 presents a diagrammatic sectional view along line II—II in FIG. 1 to illustrate the lifting frame drive arrangement, and FIG. 3 presents a sectional view along line III—III in FIG. 1, FIG. 4 presents a sectional view along line IV—IV in FIG. 3, and FIG. 5 presents a diagrammatic side view of an embodiment of the top foil wrapping machine of the invention.

DETAILED DESCRIPTION OF THE INVENTION

FIG. 1 presents a wrapping machine for wrapping a plastic foil web around an object (not shown) to be packaged. The wrapping machine comprises a machine frame 1 supported on a fixed floor base. The machine frame 1 comprises four upright vertical columns 2 arranged at a distance from each other in a rectangular configuration such that a vertical column 2 is placed at each corner of the imaginary rectangular configuration. A lifting frame 3 has been arranged to be vertically movable along the vertical columns 2 by means of a lifting motor 4. Power is transmitted by power transmission means from the lifting motor 4 to produce a vertical motion of the lifting frame 3. The power transmission means comprise flexible flat belts 5 and pulleys 6 for transmitting the power of the lifting motor 4 to the flat belts 5. A foil dispenser 7, on which a foil web roll 8 can be rotatably mounted, has been arranged to circulate on a ring-like circular path around the object to be packaged, in such manner that the plastic foil web is unrolled from the foil web roll 8, forming a wrapping around the object to be packaged, and as the frame arrangement supporting the foil dispenser is simultaneously moved vertically by moving the lifting frame, a spiral wrapping is formed around the object to be wrapped.

It is to be noted that the circulating movement of the foil dispenser 7 along a ring-like path can be achieved by other known arrangements as well, such as arrangements in which the foil dispenser is connected to a rotating crank that circulates the foil dispenser 7 about the object to be wrapped.

The lifting motor 4 is secured to the lifting frame 3 and it therefore moves with the lifting frame 3. As is also shown in FIG. 2, a drive belt pulley 6 for reeling the flat belts 5 is provided. The drive belt pulley 6 is rotatably mounted by means of a bearing on the lifting frame 3 and connected to the shaft of the lifting motor 4. The first ends 9 of the flat belts 5 are secured to the upper ends of the vertical columns 2 while their second ends 10 are secured to the drive belt pulley 6.

The lifting frame 3 has the shape of a substantially rectangular frame and it is disposed in a horizontal position within the area defined by the vertical columns 2. As can be best seen from FIGS. 1, 3 and 4, the lifting frame 3 is provided with an equipment box 11, the interior space 12 of which is defined below by a bottom 13, laterally by side walls 14, 15, 16, 17 and above by a cover 18. The lifting motor 4 is disposed in the interior space 12 of the equipment box 11. From all FIGS. 1–4 it can be seen that the lifting frame 3 comprises two elongate box-like lateral frame parts 19, 20 parallel to each other, each extending horizontally between two vertical columns 2. The drive belt pulley 6 is mounted inside the box of a lateral frame part. As shown in FIG. 1 and 2, a diverting pulley 21 is provided at each end of the two lateral frame parts 19, 20, over which pulleys the drive belt 5 coming from the drive belt pulley 6 is passed to the upper end of the vertical column 2.

As shown in FIGS. 3 and 4, the power transmission means further comprise a drive shaft 22 rotated by the lifting motor 4, which is connected to it via a reduction gear. Mounted on each end of the drive shaft 22 is a drive belt pulley 6.

Referring to FIGS. 1 and 3, the apparatus comprises a circular ring arrangement 23 forming the path of movement of the foil dispenser 7. The circular ring arrangement 23 is suspended on the lifting frame 3 so as to be vertically movable with it. The circular ring arrangement 23 comprises a circular ring-like rotary frame 25 suspended in a horizontal position on the lifting frame 3 and mounted by means of roller assemblies 28 allowing it to rotate about its center. The foil dispenser 7 is secured to the rotary frame 25 so that it circulates with the rotary frame. To rotate the rotary frame 25, a rotating motor 26 is provided. The rotating motor 26 is placed in the interior space 12 of the equipment box 11. A controller 27 arranged to control the functions of the wrapping machine, such as the lifting motor 4 and the rotating motor 26, is likewise placed in the interior space 12 of the equipment box 11.

FIG. 5 presents a top foil wrapping machine, which is capable of setting a top foil over the object (not shown) to be packaged. In respect of the machine frame 1 and the lifting frame 3 and its belt drive arrangement, the top foil wrapping machine has a construction corresponding to the wrapping machine in FIGS. 1–4. Therefore, for a description of these parts, reference is made to the above description of FIGS. 1–4. In FIG. 5, corresponding parts are indicated by corresponding reference numbers. The top foil wrapping machine has a depositor frame 102 placed below and secured to the lifting frame 3. The depositor frame 102 comprises supporting elements 103 for rotatably supporting a top foil web roll 101 on the depositor frame. Further, mounted on the depositor frame 102 is a holding device 104, which is provided with gripping jaws movable towards each other from above and below the web. The holding device 104 is designed to hold the top foil web when it is to be severed by a cutting device 106 placed near the holding device. The holding device 104 holds the end of the web until a horizontally movable gripping element 105 grips the end of the top foil web, whereupon the holding device 104 releases the web and the gripping element 105 can draw the web in its grip over the object to be packaged. The cutting device 106 then cuts the top foil web drawn over the object and the gripping element 105 at the other end releases the web from its grip, a length of top foil being thus severed and deposited over the object.

The invention is not limited to the embodiment examples described above; instead, many variations are possible within the scope of the inventive concept defined in the claims.

What is claimed is:

1. A wrapping machine for wrapping a plastic foil web around an object to be packaged, said wrapping machine comprising:

a machine frame supported on a fixed base and comprising upright vertical columns, a lifting frame arranged to be vertically movable upwards and downwards and guided by the vertical columns, a lifting motor for moving the lifting frame, power transmission means for the transmission of power from the lifting motor to produce vertical motion of the lifting frame, said power transmission means comprising elongate flexible drive elements and wheels for the transmission of the power of the lifting motor to the drive elements, a foil dispenser, on which a foil web roll can be rotatably mounted, said foil dispenser being arranged to circulate on a ring-like path about the object to be packaged for delivering a plastic foil web from the foil web roll to form a wrapping around the object to be packaged, wherein the lifting motor is secured to the lifting frame so as to be movable with said lifting frame; the wheels comprise a drive belt pulley fitted for reeling a flat belt, said drive belt pulley being rotatably mounted on bearings on the lifting frame and rotated by the lifting motor; and each of the elongate drive elements includes a drive belt having a first end secured to the upper end of the vertical columns and a second end secured to the drive belt pulley.

2. The wrapping machine according to claim 1, wherein the wrapping machine comprises four vertical columns, arranged in a rectangular configuration at the corners of a rectangle at a distance from each other; and the lifting frame has the form of a substantially rectangular frame and arranged in a horizontal orientation within the area defined by the vertical columns.

3. The wrapping machine according to claim 1, wherein the lifting frame comprises an equipment box, whose interior space is defined below by a bottom, laterally by side walls and above by a cover, and the lifting motor is mounted in said interior space.

4. The wrapping machine according to claim 1, wherein the lifting frame comprises two parallel elongated lateral frame parts, each extending horizontally between two vertical columns; and the drive belt pulley is mounted in a position aligned with a lateral frame part and a diverting pulley is provided at each end of the two lateral frame parts, the drive belt coming from the drive belt pulley being passed over the respective diverting pulley to the upper end of the vertical column.

5. The wrapping machine according to claim 1, wherein the power transmission means comprise a drive shaft to which the lifting motor is coupled to rotate said drive shaft, a drive belt pulley being mounted on each end of said drive shaft.

6. The wrapping machine according to claim 1, wherein the wrapping machine comprises a circular ring arrangement, which forms the path of motion of the foil dispenser and which is so mounted on the lifting frame as to be vertically movable with said lifting frame.

7. The wrapping machine according to claim 6, wherein the circular ring arrangement comprises a ring-like rotary frame suspended horizontally so that said rotary frame is carried by the lifting frame and mounted on bearings on the lifting frame to allow said rotary frame to rotate about a center thereof, the foil dispenser being secured to said rotary frame to circulate with said rotary frame, and a rotating motor for rotating the rotary frame.

8. The wrapping machine according to claim 7, wherein the rotating motor is placed in the interior space of the equipment box.

9. The wrapping machine according to claim 7, wherein the wrapping machine comprises a control device for controlling the operation of the wrapping machine, such as the lifting motor and/or the rotating motor, and the control device is placed in the interior space of the equipment box.

10. A top foil wrapping machine, comprising:

a machine frame supported on a fixed base and comprising upright vertical columns, a lifting frame arranged to be vertically movable upwards and downwards and guided by the vertical columns, a lifting motor for moving the lifting frame, power transmission means for the transmission of power from the lifting motor to produce a vertical motion of the lifting frame, said power transmission means comprising elongate flexible drive elements and wheels for the transmission of the power of the lifting motor to the drive elements, a top foil depositor arranged to deposit a top foil from a top foil web roll onto the object to be packaged, wherein the lifting motor is secured to the lifting frame so as to be movable with said lifting frame; the wheels comprise a drive belt pulley fitted for reeling a flat belt, said drive belt pulley being rotatably mounted on bearings on the lifting frame and rotated by the lifting motor; and each of the elongate drive elements includes a drive belt having a first end secured to the upper end of the vertical columns and a second end secured to the drive belt pulley.

11. The wrapping machine according to claim 10, wherein the top foil wrapping machine comprises four vertical columns arranged in a rectangular configuration at the corners of a rectangle at a distance from each other; and the lifting frame has the form of a substantially rectangular frame and arranged in a horizontal orientation within the area defined by the vertical columns.

12. The wrapping machine according to claim 10, wherein the lifting frame comprises an equipment box, whose interior space is defined below by a bottom, laterally by side walls and above by a cover, and the lifting motor is mounted in said interior space.

13. The wrapping machine according to claim 10, wherein the lifting frame comprises two parallel elongate lateral frame parts, each extending horizontally between two vertical columns; and the drive belt pulley is mounted in a position aligned with a lateral frame part and a diverting pulley) is provided at each end of the two lateral frame parts, the drive belt coming from the drive belt pulley being passed over the respective diverting pulley to the upper end of the vertical column.

14. The wrapping machine according to claim 10, wherein the power transmission means comprise a drive shaft to which the lifting motor is coupled to rotate said drive shaft, a drive belt pulley being mounted on each end of said drive shaft.

15. The wrapping machine according to claim 10, wherein the top foil depositor comprises a depositor frame secured to the lifting frame, supporting elements for rotatably supporting a top foil web roll on the depositor frame, a holding device for holding the end of the top foil web, a horizontally movable gripping element for gripping the end of the top foil web, taking it from the hold of the holding device and drawing it over the object to be packaged, and a cutting device for cutting the top foil web drawn over the object.

16. A wrapping machine, comprising:

a machine frame supported on a fixed base and comprising upright vertical columns, a lifting frame arranged to be vertically movable upwards and downwards and guided by the vertical columns, a lifting motor for moving the lifting frame, a power transmission unit for the transmission of power from the lifting motor to produce vertical motion of the lifting frame, said power transmission unit comprising elongate flexible drive elements and wheels for the transmission of the power of the lifting motor to the drive elements, a foil dispenser for delivering a wrapping foil web from a foil web roll to an object to be packaged, wherein the lifting motor is secured to the lifting frame so as to be movable with said lifting frame; the wheels comprise a drive belt pulley fitted for reeling a flat belt, said drive belt pulley being rotatably mounted on bearings on the lifting frame and rotated by the lifting motor; and each of the elongate drive elements includes a drive belt having a first end secured to the upper end of the vertical columns and a second end secured to the drive belt pulley.

* * * * *